US005243318A

United States Patent [19]

Greenstein

[11] Patent Number: 5,243,318

[45] Date of Patent: Sep. 7, 1993

[54] LOW NOISE PRECISION RESISTOR

[75] Inventor: Bernard Greenstein, Glenview, Ill.

[73] Assignee: Beltone Electronics Corporation, Chicago, Ill.

[21] Appl. No.: 685,453

[22] Filed: Apr. 12, 1991

Related U.S. Application Data

[63] Continuation-in-part of Ser. No. 683,990, Apr. 11, 1991, abandoned.

[51] Int. Cl.[5] ..... H01C 10/10

[52] U.S. Cl. ..... 338/195; 338/185; 338/322; 338/333

[58] Field of Search ..... 338/195, 162, 171, 123, 338/124, 125, 129, 185, 186, 333, 322-332

[56] References Cited

U.S. PATENT DOCUMENTS

| | | | |
|---|---|---|---|
| 3,717,837 | 2/1973 | MacLachlan | 338/160 |
| 4,123,742 | 10/1978 | Nakamura et al. | 338/137 |
| 4,163,315 | 8/1979 | Neese | 29/620 |
| 4,329,676 | 5/1982 | McDonald et al. | 338/198 |
| 4,345,235 | 8/1982 | Riley et al. | 338/176 |
| 4,345,236 | 8/1982 | Eichelberger et al. | 338/176 |
| 4,352,084 | 9/1982 | Graves et al. | 338/127 |
| 4,435,691 | 3/1984 | Ginn | 338/125 |
| 4,527,041 | 7/1985 | Fai | 219/121 |
| 4,647,899 | 3/1987 | Moy | 338/309 |
| 4,649,366 | 3/1987 | McDonald | 338/134 |
| 4,841,275 | 6/1989 | Murata | 338/195 |
| 5,051,719 | 9/1991 | Gaston et al. | 338/195 X |

*Primary Examiner*—Marvin M. Lateef

*Attorney, Agent, or Firm*—Dressler, Goldsmith, Shore, Sutker & Milnamow, Ltd.

[57] ABSTRACT

A low noise miniature potentiometer utilizes thick film deposits of resistive material which extend adjacent to deposits of conductive material. The conductive region is sliced into a plurality of spaced-apart conductive elements. Electrical paths through resistive elements can be lengthen by laser trimming of the resistive material thereby providing for very precise incremental resistances between pairs of spaced apart conductive elements. If desired, an increased range of resistivity can be achieved by utilizing a second deposited thick film region extending along the conductive region and in contact therewith. Laser trimming can be used to increase conductive path lengths in the second resistive element thereby providing a broader range of resistance values.

34 Claims, 3 Drawing Sheets

Fig. 3
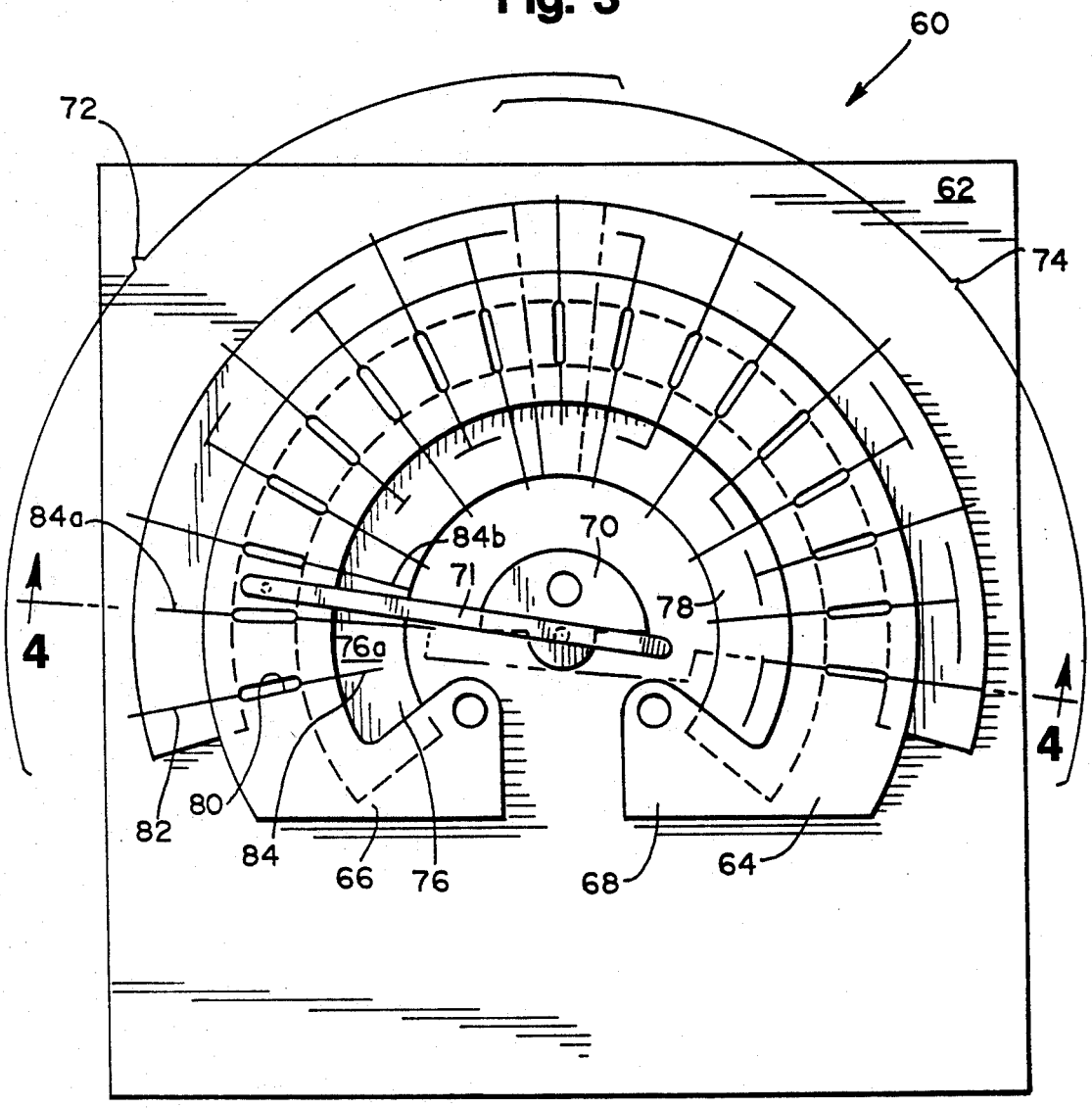
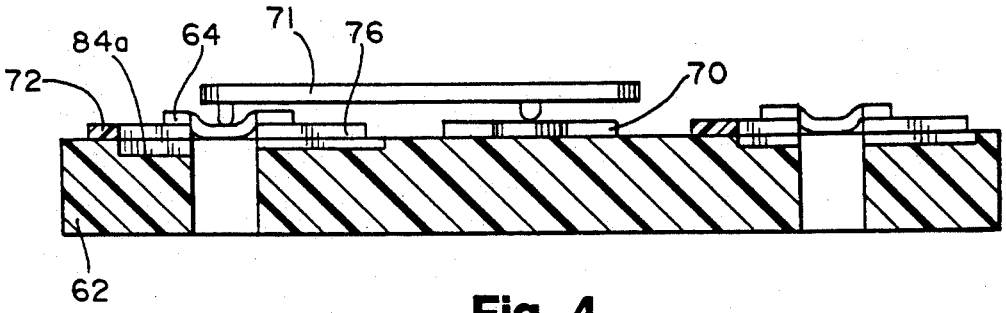
Fig. 4

LOW NOISE PRECISION RESISTOR

This is a continuation-in-part of the U.S. patent application filed Apr. 11, 1991 entitled "Low Noise Precision Resistor", Ser. No. 07/683,990 now abandoned.

FIELD OF THE INVENTION

The invention pertains to variable resistors, such as potentiometers. More particularly, the invention pertains to miniature, low noise, variable resistive elements which can be formed of relatively inexpensive thick film deposition processes.

BACKGROUND OF THE INVENTION

Prior art potentiometers are known wherein a variable center contact is moved across or along a resistive element. The resistive element can be a continuously extending region of resistive material. Alternately, it can be formed of a plurality of overlapping or abutting resistive materials of different lengths or resistivities.

Such potentiometers are known to suffer from noise problems since the conductive wiper blade moves on the resistive material directly. An alternate prior art potentiometer structure utilizes a plurality of spaced-apart conductive members with resistors coupled therebetween. The wiper element moves along the conductive regions and not on the resistors themselves. This structure requires the ability to precisely deposit a plurality of spaced-apart conductive regions as well as the ability to precisely deposit a plurality of spaced-apart resistors linking spaced-apart conductive regions.

As potentiometer sizes get smaller and smaller, it becomes more difficult and expensive to precisely define the shape and structure of the spaced-apart conductive pads, as well as the resistor elements linking same.

Another disadvantage of prior art potentiometers formed with spaced-apart conductive regions is that as the wiper blade moves from region to region conductive material migrates into the space between the conductive shapes. Eventually enough of this conductive material is spread between the two-spaced apart pads to short out the resistor therebetween.

Another disadvantage of prior art potentiometers which incorporate spaced-apart conductive regions arises because it may be desirable to laser trim the resistor element between pairs of conductive elements to enhance the precision of the resultant potentiometer. Such trimming requires smaller and smaller probes capable of electrically contacting the two spaced apart conductive pads adjacent to one another. As it becomes more and more important to create smaller and smaller potentiometers, the probes required for trimming a resistive element between spaced apart conductive pads become smaller and smaller and more expensive.

Thus, it would be desirable to be able to form variable resistance or potentiometer elements which exhibit low noise with precisely defined resistance values varying over five or six or more orders of magnitude, in an economical fashion. Preferably, precision resistance values can be achieved without any need for precisely controlling the dimensions or shapes of resistance value. Further, it would be desirable to be able to achieve this result using two non-moving probes during the process of adjusting resistance values.

SUMMARY OF THE INVENTION

A miniature variable resistance device in accordance with the present invention exhibits both low noise characteristics and low contact resistance. Various resistance functions can be provided. These include linear, as well as logarithmic.

The device includes an elongated resistive element and a substantially conductive member which extends in contact with the resistive element. Both the resistive element and the conductive element can be deposited using inexpensive, conventional thick film fabrication techniques.

The conductive member is interrupted by a plurality of spaced-apart discontinuities o slots therein. At least some of the discontinuities extend a predetermined amount into adjacent respective portions of the resistive element.

The resistive element can be curved or generally linear in shape. Both the resistive element and the conductive member can be carried on an insulating base. The base can be either planar or curved.

A plurality of resistive values is defined in the resistive element by selectively scribing the resistive element thereby forming non-conductive open regions therein. The scribings are adjacent to members of the plurality of discontinuities.

A particular resistive value can be formed of one or more conductive members separated by pairs of discontinuities and electrically coupled together by portions of the resistive element. The value of an incremental resistive element, located between two spaced apart conductive regions, is determined by the extent to which the adjacent elongated resistive material is scribed thereby altering a resistive path therethrough.

Increasing the total value of resistance in the element involves adding further incremental resistive elements to those which have already been part of the resistive path. Incremental resistance values can also be changed by forming the elongated resistive element from two or more films or layers having different resistivity.

An increased range of resistance values can be achieved by depositing a second elongated resistive element in contact with the conductive member and spaced apart of the initial resistive element. By also scribing the second elongated resistive element, additional conducting paths can be created providing numerous additional incremental resistive elements. These elements can then be used, by linking same to other resistive elements in the device, to substantially increase the range of resistance provided within the device.

The resistive elements can be deposited on an insulating substrate using any conventional process. Both thick and thin film deposition methods can be used. Additionally, thick film resistive elements can be printed onto the substrate using conventional thick film techniques and fired thereon to form a physically stable structure.

In the above-described resistance device contact to a variable wiper is made on the conductive material not on any of the resistive material. As a result, there are no limitations as to the resistance values of these devices. Because the wiper is in contact with the conductive member, the device exhibits both a low contact noise and low contact resistance.

Since the incremental resistance values are set by scribing or by laser trimming, the deposited layer of resistance material need not be a high quality deposition which relies for resistance values on controlled physical geometry. Hence, very precise incremental resistance segments, on the order of plus or minus 1% of nominal or less, can be achieved using relatively inexpensive thick film printing techniques.

The device can be mounted in a housing and a linearly movable or rotatable knob can be associated with the wiper element for the purpose of manually altering the resistance value between one end of the device and the movable contact. The assembled device can then be soldered or otherwise attached to a printed circuit board and related circuitry.

Since the resistive material can be applied using a printing process, it is very easy to make any desired shape. On the other hand, since the precision resistance values are achieved by laser trimming in a continuously extending resistive member, unlike the prior art, it is unnecessary to precisely control the geometry of a plurality of discrete film resistors. It is a further advantage of a device as described above that the precise incremental resistor values are achieved relatively independently of printing and/or deposition variations since laser trimming is used to achieve the desired values.

Another advantage of a resistive element as described above is that probes used for measuring the incremental resistance values during the laser trimming process are located at the ends of the conductive member and are not located adjacent to the resistance element that is being trimmed. Hence, larger probe contact end regions can be provided than are present between resistance elements. In addition, the probes need not be moved during the trimming operation.

A method of producing different resistance values between first and second contact regions includes the steps of providing an elongated conductive element, and providing an elongated substantially continuous resistive element in contact with portions of the conductive element.

A particular resistance value is determined between a first and a second contact region by a path which extends therebetween and which includes part of the conductive element and part of the continuous resistive element. A second, higher resistance value, can be achieved by selecting a longer path between the first region and another region displaced from the second region. This path will include portions of the conductive element and a longer part of the continuous resistor element in accordance with the higher desired resistance value.

Numerous other advantages and features of the present invention will become readily apparent from the following detailed description of the invention and the embodiments thereof, from the claims and from the accompanying drawings in which the Details of the invention are fully and completely disclosed as a part of this specification.

BRIEF DESCRIPTION OF THE DRAWINGS

FIG. 3 is a top an view of a non-linear resistive element in accordance with the present invention;

FIG. 4 is a sectional view taken alone plane 4—4 of FIG. 3;

DETAILED DESCRIPTION OF THE PREFERRED EMBODIMENTS

Figure 1:
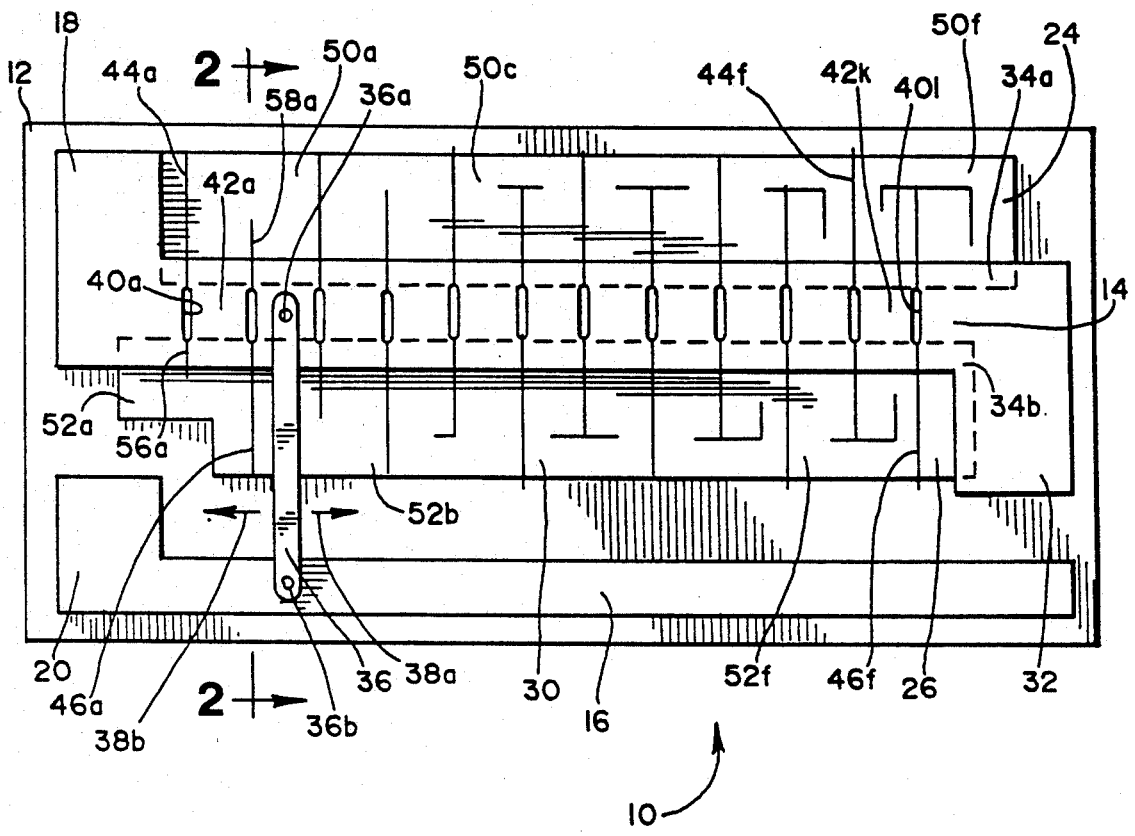
FIG. 1 is a top plan view of a linear resistive element in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 2:
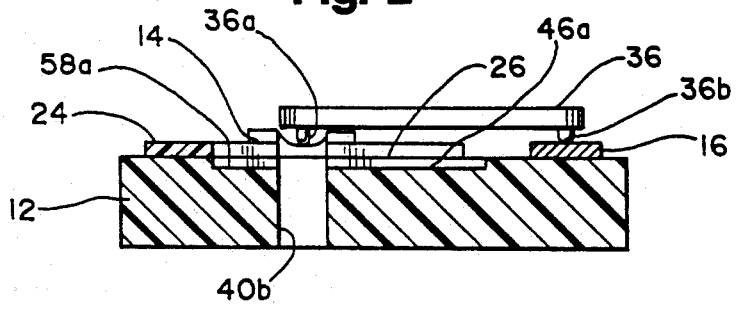
FIG. 2 is a sectional view taken alone plane 2—2 of FIG. 1.

FIGS. 1 and 2 illustrate a linear potentiometer 10 which embodies the present invention. A substrate 12 which can be formed of $Al_2O_3$ carries first and second elongated spaced-apart conductors 14 and 16 thereon. Each of the conductors has an enlarged end region, 18 and 20 respectively. Each end region serves as a contact point or connection region to external circuitry.

The potentiometer 10 also includes first and second elongated layers 24 and 26 of resistive material. The layers 24 and 26 can be deposited either before or after the conductor conductive layers 14 and 16 have been deposited.

The method of depositing the resistive layers 24 and 26, while not a limitation of the present invention, can be by thick film deposition methods of a conventional nature. For example, conventional methods of thick film printing followed by subsequent firing of the layers can be used.

It is a particular advantage of the present invention that the layers 24 and 26 need not be deposited with high precision, nor with great uniformity, nor with precise geometry in order to achieve precise resistance values in the final product on the order of plus or minus 1% nominal or better. As a result, potentiometers, such as potentiometer 10, can be fabricated very inexpensively.

While the potentiometer 10 has been illustrated as having two spaced-apart elongated resistive layers 24 and 2 it will be understood that only one layer is necessary to form an operative device. Further, it will be understood that while the layers 24 and 26 have been illustrated as being formed of a continuously extending layer of the same type of resistive material, both layers 24 and 26 could be formed with two or more different types of resistive materials with one type being deposited starting adjacent to region 18 and region 20 and extending along the substrate 10 some predetermined distance to a region 30.

A second resistive material, of a higher resistivity can then be deposited starting from the vicinity of the region 30 extending to a distal end 32 of the conductive layer 14. The end region 32 is usable as a contact region to external circuitry and as a probe region during manufacturing.

It should also be noted that the conductive layer 14 and the resistive layers 24 and 26 overlap each other, in part, as in regions 34*a* and 34*b*.

A slider 36 is in electrical contact with the conductive layer 14 and the conductive layer 16. The slider 36 is movable axially on the substrate 12 in directions 38*a* and 38*b* respectively.

By moving the slider 36, the resistance of the potentiometer 10 between the contact or probe points 18 and 20 can be varied. The distal end region 32 of the region 14 provides a third electrical contact to the potentiometer 10 as is conventional.

After the film deposition process, the conductive layer 14 which is deposited as a continuously extending electrically conductive path is sliced by a group of centrally located slots 40*a*–40*l*. The slots 40*a*–40*l* could be cut by means of a computer controlled laser. These slots extend through the conductor 14 and either partially or completely through the substrate 12 in the region between the resistive layers 24 and 26.

The slots 40*a*–40*l* thus define a plurality of conductive segments 42*a*–42*k*. A contact region 36*a* slidably engages the regions 42*a*–42*k* as the slider 36 moves back and forth in the directions 38*a* or 38*b*. A second contact region 36*b* slidably engages the conductive layer 16.

The slots 40*a*–40*l* are cut either completely or partially through the base member 12 with a width on the order of 0.002 inches for the purpose of resisting migration of conductive material between segments. This migration is promoted by the movement of the contact region 36*a* from one segment, such as 42*a* across an intervening opening 40*b* onto the second segment 42*b*.

In a subsequent manufacturing step, a plurality of interruptions in the resistive layers 24 and 26, as well as the conductive layer 14 can be formed by a laser scribing operation. Slots or interruptions 44*a*–44*f* are associated with resistive layer 24. Slots 46*a*–46*f* are associated with the resistive layer 26. The laser scribed interruptions or slots 44*a*–44*f* and 46*a*–46*f* create a plurality of resistive elements such as resistive elements 50*a*–50*f* in the layer 24 and 52*a*–52*f* in the layer 26.

The resistive elements 50*a*–50*f* and 52*a*–52*f*, after appropriate adjustment, form highly precise resistor segments for the potentiometer 10. The adjustment of the resistive values 50*a*–50*f* and 52*a*–52*f* is accomplished using only two probes in contact with probe points 18 and 32 in combination with further laser scribing operations associated with each of the openings 40*a*–40*l*.

The resistive element 52*a* is adjusted to a predetermined precise value by laser scribing and forming an interruption 56*a* therein. The length of the interruption 56*a* produced by the laser scribing operation is determined by the desired resistance to be associated with region 52*a* which is read very readily and quickly via probe points 18 and 32.

Electrical conductivity exists between the element 42*a* and the distal end probe 32. Subsequent to forming the interruption 56*a*, the value of resistance element 50*a* can be adjusted by another laser scribing operation which forms an interruption 58*a*.

In this instance, the length of the scribed region 58*a* can be set by measuring between probe point 18 and distal end probe point 32 which results in an effective total resistance including the value of resistance of 52*a*, as previously trimmed, and the current value of resistive element 50*a* to be trimmed by formation of the scribed region 58*a*. Subsequently, each of the remaining resistor regions 52*b*–52*f* and 50*b*–50*f* can be trimmed in a laser scribing operation.

As illustrated in regions 50*c* and 52*f* by directing the laser scribe to form longer slices or slots in the respective element, the effective resistance of each respective element can be increased. Depending on the way in which the various respective laser scribing operations are carried out, the potentiometer 10 can be formed with a linear resistance characteristic, a logarithmic resistance characteristic or any other characteristic as resistance increases from region 52*a* through region 50*f*.

While the potentiometer 10 described above has been illustrated on a planar substrate 12, it will be understood that the substrate 12 could be curved or cylindrical without departing from the spirit and scope of the present invention.

While the resistive layers 24 and 26 have been illustrated in the potentiometer 10 as being elongated, generally rectangular in shape, it will be understood that other shapes can be used without departing from the spirit and scope of the present invention.

The potentiometer 10 is a very low noise device because the slider 36 makes contact on the deposited conductive layer 14 and not on either of the resistive layers 24 and 26. Further, by means of the laser scribing and the cuts 58*a* and 56*a* which are made in the deposited resistor regions 24 and 26, respectively, it is possible to vary the value of resistance from a minimum value to a maximum value of the potentiometer 10 over wide ranges while retaining the relatively simply geometry illustrated in FIG. 1.

Substantial variations in resistance of the potentiometer 10 can be readily achieved using standardized shapes of resistor elements such as 50*a* and 52*b* since the laser scribing operation can create convoluted electrical paths as illustrated in the resistive region 50*f*. This results in a very cost effective structure since the laser scribing operations can be computer controlled to achieve the desired resistance variations.

It will also be understood that various types of materials, such as an epoxy based printed circuit board can be used for the substrate 12. Another advantage of the potentiometer 10 is that it can be made quite small and it is very inexpensive and simple to fabricate.

With respect to FIG. 1, the first series of cuts 44*a*–44*f* using the laser delineates the individual resistor elements such as 50*a*–50*f*.

However, this slicing sequence leaves a continuous conductive path until the resistors are trimmed. Defining the resistors in this manner allows one to separate the resistors and conductor sections by 0.002". This separation distance is not achievable by printing Therefore, with thick film processing, one gets the advantages of photolithographic dimensioning, this making pattern sizes comparable to smaller more expensive techniques without the difficult alignment. The present method also enables the use of only two probes to measure all resistance trim values further minimizing the areas needed.

The second series of cuts, such as cut 58*a* now trims the resistance value of each resistive element. By normal thick film processing and printing spacing one can not achieve a 2 MIL separation between elements as achieved by using 2 MIL laser cuts as here.

FIG. 3 illustrates a curved potentiometer 60. FIG. 4 is a sectional view of the potentiometer 60. The potentiometer 60 is formed on a planar substrate 62 and includes a generally semi-circular conductive layer 64 having end, probe regions 66 and 68. The probe regions 66 and 68 correspond to the conventional end connector points to a potentiometer. A centrally located conductive region 70 deposited on the substrate 62 forms a central contact region for a rotatable slider member 71.

The potentiometer 60 also includes first and second spaced-apart curved resistive layers 72, 74, 76 and 78. The layers 72 and 76 are formed of the same resistivity material. The layers 74 and 78 are formed of a higher resistivity material.

As was the case with the linear potentiometer of FIG. 1, the arcuate conductive member 64 is interrupted via a plurality of slots, such as a slot 80 which extends partially or all the way through the substrate 62. Associated with each of the slots, such as the slot 80 is a laser scribed cut 82 on the order of two mils wide and which extends from an end of the opening 80 through the adjacent resistive layer 72.

A first resistive element 76*a* is trimmed to a precise resistance value using probe regions 66 and 68 respectively by a laser cut 84. As described previously with respect to the potentiometer 10, a plurality of subsequent laser scribed cuts, including cuts 84*a* and 84*b*, is formed in respective resistive layers 72 and 76 as well as layers 74 and 78. These cuts precisely trim the values of the respective resistive elements of the potentiometer 60 to plus or minus one percent of nominal or less.

The potentiometer 60 can be coupled to an adjacent electrical circuit by electrically coupling the circuit to end contacts 66 and 68 of the potentiometer as well as variable center contact 70 thereof.

Figure 5:
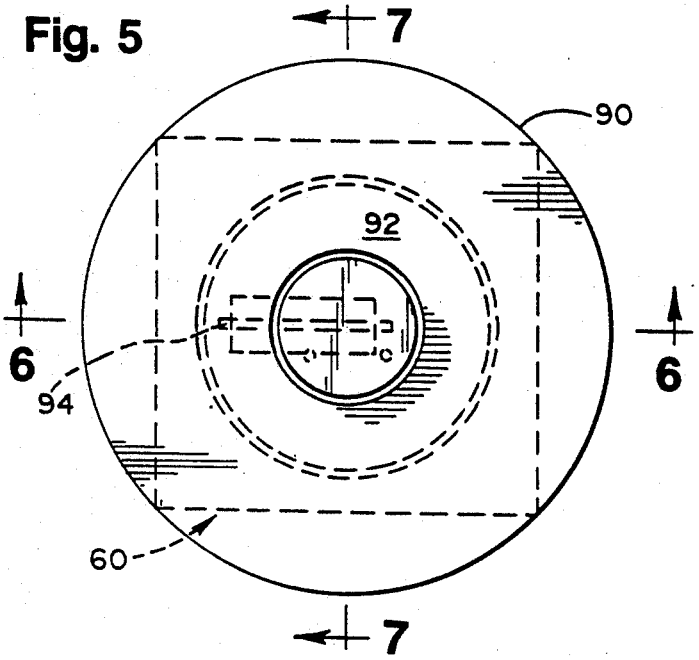
FIG. 5 is a top plan view of a housing usable with the resistive element of FIG. 3.
Figure 6:
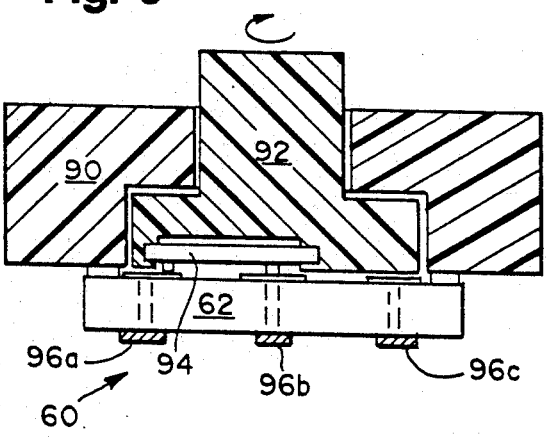
FIG. 6 is a side sectional view taken along plane 6—6 of FIG. 5.
Figure 7:
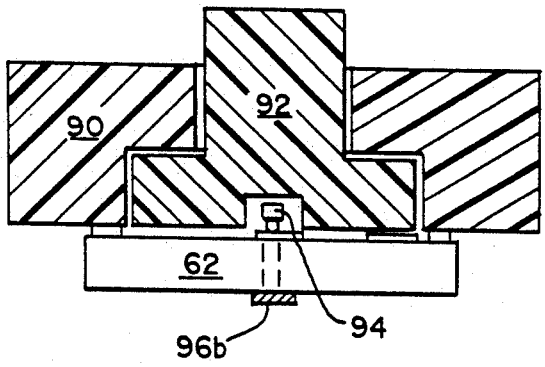
FIG. 7 is a side sectional view, perpendicular to the view of FIG. 6, taken along plane 7—7 of FIG. 5.

FIG. 5 illustrates the potentiometer 60 mounted in a generally cylindrical housing 90. FIGS. 6 and 7 are sectional views of the housing 90. The housing 90 has a rotatably mounted central region 92.

Rotating the region 92 rotates a wiper 94 of the potentiometer 60. Feed throughs 96*a*–96*c* can be used to electrically couple the end regions 66 and 68 as well as the wiper central region 70 to the associated electrical circuit.

The housing 90 can be attached to the substrate 60 via adhesive of any conventional variety. It will be understood that the exact shape of the housing 90 is not a limitation of the present invention.

The potentiometer 60 and associated housing 90 can be made very small physically and used in a variety of applications, such as hearing aids, where size is critical. The rotatable portion 92 of the housing 90 provides a mechanism for manually adjusting the setting of the potentiometer.

Figure 8:
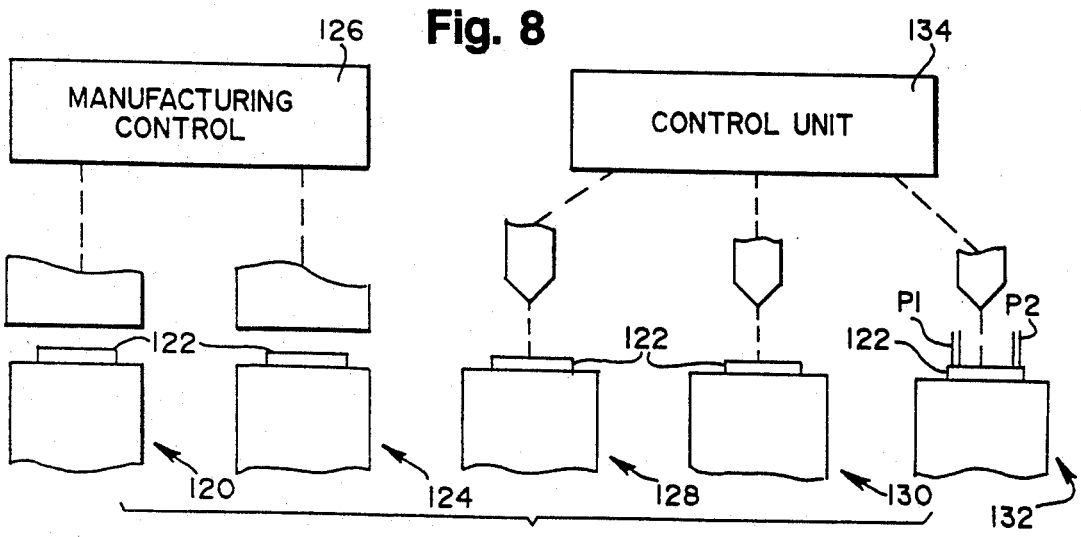
FIG. 8 is a schematic diagram illustrating steps of manufacturing a resistive element in accordance with the present invention.

FIG. 8 illustrates schematically a method of making a potentiometer such as the linear potentiometer 10 or rotary potentiometer 60. In an initial step, at a station 120, layers of conductive material are printed or otherwise deposited on a substrate 122. Depending on the type of deposition process, the station 120 may include a structure for firing or otherwise physically fixing the deposited conductive material onto the substrate 122.

In another step at a station 124, one or more layers of resistive material are deposited on the substrate 122. The resistive material may also be fired depending on the deposition process used. The deposition processes at stations 120 and 124 are carried out under the control of a manufacturing process control unit 126. Depending on the process used, the resistive material could be deposited first.

In a subsequent step, at station 128, the major spaced-apart slots, such as slots 40*a*–40*l* or slots 80 are cut into the deposited layers and either partially or completely through the substrate 122. The slotting operation is carried out using a relatively high powered laser cutting tool.

In a subsequent step, at a station 130, the first scribing operation is carried out on the unit. At this step, laser cuts are made into the resistive layers and portions of the conductive layers corresponding to slots 44*a*–44*f*.

At a final station 132, the values of various resistor segments, such as the resistor segment 58, are trimmed using probes P1 and P2 and a laser cutting tool, which could be the same tool as used in station 130, for the purpose of precisely adjusting the effective value resistance of each of the segments. The various slottings, scribing operations of stations 128, 130 and 132 are carried out under the control of process control unit 134.

The processed element 122 can then be combined with a wiper contact and a housing. A linear or rotary potentiometer can be formed.

It will be understood that variations could be made to the above-described steps without departing from the spirit and scope of the present invention.

It will be understood that a resistive element in accordance with the present invention can be formed using both sides of the substrate 62. In this embodiment, in addition to the conductive element 64 illustrated in FIG. 3 which is deposited on a first side of substrate 62, a second circular conductive element can be deposited on a second side of the substrate 62 displaced from the first side.

The conductive member 64 can be conductively connected to the deposited conductor on the second surface of the substrate 62 using vias or other forms of plated through holes. The second deposited conductive surface can be sliced into a plurality of isolated regions, corresponding to each of the regions of the member 64.

A wiper, such as the wiper 94, can be rotatably affixed to the second side of the substrate 62 for purposes of altering the resistance between an end region, such as the region 66 and the rotatable wiper. The advantage of this embodiment is that the wiper can contact a larger area for each of the segments.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

We claim:

1. A variable resistance device comprising:

an elongated, substantially continuous resistive element;

a substantially continuous, elongated, conductive member , extending in contact with said resistive element, at least in predetermined regions, with said conductive member interrupted by a plurality of discontinuities defined thereon with at least some of said discontinuities extending a predetermined amount into adjacent respective portions of said resistive element and wherein an elongated portion of said conductive member is not covered by said resistive element.

2. A device as in claim 1 with said element having a curved shape.

3. A device as in claim 1 with said element having a generally linear shape.

4. A device as in claim 1 with said conductive member formed of a conducting, planar metallic element positioned next to said resistive 5. A device as in claim 1 having a planar substrate with said resistive element and said conductive element carried thereon.

6. A device as in claim 5 including a manually operable member for varying a resistance parameter thereof.

7. A device as in claim 1 including a second elongated, substantially continuous resistive element extending in contact with said conductive member with at least some of said discontinuities extending a predetermined amount into adjacent respective portions of said second resistive element.

8. A device as in claim 1 including first and second electrical contact regions with said first region associated with a predetermined fixed portion of said conductive member and with said second region associatable with a selected one of a plurality of displaced regions defined on said conductive member.

9. A device as in claim 8 including a manually operable element for selecting said one region from said plurality of defined regions.

10. A low wear variable resistance unit comprising:

a first resistive element;

a second resistive element displaced from said first element;

a conductive member having a base portion and an extending portion in electrical contact with each of said elements; and a plurality of spaced apart interruptions in said extending portion with at least some of said interruptions selectively extending into at least one of said elements to provide a plurality of resistive paths between said base portion and a plurality of intermediate regions of said extending portion with a different resistance parameter associated with each said path.

11. A unit as in claim 10 including a movable contact, electrically couplable to one of said intermediate regions of said extending portion and movable thereon for selecting one of said resistive paths.

12. A unit as in claim 10 with at least some of said interruptions selectively extending into the other of said elements.

13. A unit as in claim 10 with said resistive elements having an elongated generally linear shape.

14. A unit as in claim 10 with each of said resistive elements having a non-linear shape.

15. A unit as in claim 10 including a movable, path selecting contact electrically coupled to said extending portion.

16. A unit as in claim 10 including a housing defining an internal region with said resistive elements carried, at least in part, therein.

17. A unit as in claim 10 wherein said elements are formed of a deposited, substantially constant resistivity material.

18. A unit as in claim 17 with said deposited material being substantially planar.

19. A unit as in claim 10 with said elements and said conductive member carried on an insulative base.

20. A planar resistive device comprising:

a planar insulating base;

at least a first resistive element carried on said base;

a planar conductor carried on said base, adjacent to said element, and overlapping same at least in part;

a first plurality of spaced apart interruptions in said conductor with each pair of adjacent ones of said interruptions defining a respective region therebetween in said conductor;

a second plurality of spaced apart interruptions extending into at least some parts of said element with some of said members of said second plurality associated with corresponding members of said first plurality thereby defining a plurality of different conductive paths between a first part of said conductor and said plurality of regions.

21. A resistive device as in claim 20 including:

a second resistive element carried on said base, displaced from said first element, with said conductor partly overlapping same; and a third plurality of spaced apart interruptions extending into at least some parts of said second element with some members of said third plurality associated with corresponding members of said first plurality.

22. A resistive device as in claim 20 with said element an essentially continuous, substantially planar deposit on said base.

23. A resistive device as in claim 20 with said conductor an elongated film-like member.

24. A device as in claim 20 with said element and said conductor each having a curved shape.

25. A method of providing different resistance values between first and second contact regions comprising:

providing a conductive element;

providing an elongated substantially continuous resistive element;

placing the resistive element into contact with the conductive element with an elongated region of said conductive element not covered by said resistive element;

selecting a path between the first and second regions which includes part of the conductive element and part of the continuous resistive element in accordance with a predetermined resistance value; and selecting another, longer, path between the first region and another region displaced from the second region which includes part of the conductive element and a longer part of the continuous resistance element in accordance with a higher predetermined resistance value.

26. A method as in claim 25 including:

providing a second, elongated, substantially continuous resistive element;

placing the second element into electrical contact with the conductive member, displaced from the resistive element; and selecting yet another path which includes part of the conductive element and parts of both resistive elements in accordance with yet another path having a predetermined resistance value.

27. A method of making a precision, low noise resistance element comprising:

depositing an elongated, substantially continuous resistance member;

depositing an elongated substantially continuous conducting element in electrical contact with the resistance member with an elongated region of the conducting element not covered;

creating a plurality of spaced apart interruptions in the conducting element;

creating a plurality of conducting paths which include portions of the conducting element and portions of the resistance member defined by a plurality of interruptions in the resistance member with at least some of the paths having different resistance values.

28. A method as in claim 27 including forming a plurality of incremental resistive elements with each element having a predetermined resistance value by probing only two regions of the conducting element.

29. A device as in claim 1 with said resistive element and a portion of said conductive element carried on a first side of said planar substrate and with another portion of said conductive element carried on a second side of said planar substrate displaced from said first side.

30. A device as in claim 29 including a manually operable member, carried on said second side, for varying a resistance parameter thereof.

31. A variable resistance device comprising:

a substrate;

an elongated, substantially continuous resistive element carried on said substrate;

a substantially continuous, elongated, conductive member carried on said substrate and extending in contact with said resistive element, wherein an elongated region of said conductive member, extending along said resistive element, is not covered thereby, and wherein said conductive member is interrupted by a plurality of spaced apart dicontinuities therein, such that an electrical path is established between first and second of said discontinuities through an adjacent portion of said resistive element.

32. A device as in claim 31 wherein at least some of said discontinuities extend into adjacent regions of said resistive element.

33. A device as in claim 31 wherein at least some of said discontinuities extend, in part, into said substrate.

34. A device as in claim 31 including a wiper in slidable contact with said elongated region.

* * * * *

UNITED STATES PATENT AND TRADEMARK OFFICE

CERTIFICATE OF CORRECTION

PATENT NO. : 5,243,318

DATED : September 7, 1993

INVENTOR(S) : Bernard Greenstein

It is certified that error appears in the above-indentified patent and that said Letters Patent is hereby corrected as shown below:

Column 2, line 15, "o slots" should be --or slots--.

Column 4, line 48, "2" should be --26--.

Column 8, Claim 4, line 68, please add --element.-- after "resistive".

Signed and Sealed this

Twenty-first Day of February, 1995

Bruce Lehman

*Attest:*

BRUCE LEHMAN

*Attesting Officer*

*Commissioner of Patents and Trademarks*